US011273560B2

(12) United States Patent
Godfrey

(10) Patent No.: US 11,273,560 B2
(45) Date of Patent: Mar. 15, 2022

(54) KNIFE WITH RICASSO ANGLE ASSIST BEVEL

(71) Applicant: Steven R. Godfrey, Phoenix, AZ (US)

(72) Inventor: Steven R. Godfrey, Phoenix, AZ (US)

(73) Assignee: Steven R. Godfrey, Phoenix, AZ (US)

( * ) Notice: Subject to any disclaimer, the term of this patent is extended or adjusted under 35 U.S.C. 154(b) by 26 days.

(21) Appl. No.: 16/706,369

(22) Filed: Dec. 6, 2019

(65) Prior Publication Data

US 2020/0180172 A1 Jun. 11, 2020

Related U.S. Application Data

(60) Provisional application No. 62/777,089, filed on Dec. 8, 2018.

(51) Int. Cl.

| | |
|---|---|
| ***B26B 9/00*** | (2006.01) |
| ***B26B 3/00*** | (2006.01) |
| *B24B 3/50* | (2006.01) |

(52) U.S. Cl.

CPC ..... *B26B 9/00* (2013.01); *B26B 3/00* (2013.01); *B24B 3/50* (2013.01)

(58) Field of Classification Search

CPC ..... B26B 9/00; B26B 3/00

USPC ..... 30/357

See application file for complete search history.

(56) References Cited

U.S. PATENT DOCUMENTS

| | | | | |
|---|---|---|---|---|
| 2,566,112 | A * | 8/1951 | Barnard | B26B 9/00 30/357 |
| 3,595,104 | A * | 7/1971 | Cooper | B26B 3/06 76/104.1 |
| 3,800,632 | A | 4/1974 | Juranitch | |
| 4,495,698 | A * | 1/1985 | Gerber, Jr. | B26B 9/00 30/357 |
| 4,627,194 | A | 12/1986 | Friel | |
| 5,458,534 | A | 10/1995 | Campione et al. | |
| 5,461,785 | A * | 10/1995 | Sol Na | B25F 1/00 30/138 |
| 7,517,275 | B2 | 4/2009 | Friel, Sr. et al. | |
| 8,592,711 | B2 * | 11/2013 | Lambert | B26B 9/00 219/76.13 |
| 9,902,013 | B2 * | 2/2018 | Uemura | C23C 8/38 |
| 10,272,535 | B1 | 4/2019 | Lyons et al. | |
| 10,993,377 | B1 * | 5/2021 | Terrell | A01G 3/00 |
| 2006/0207110 | A1 * | 9/2006 | Nishigaki | B26B 9/02 30/350 |

(Continued)

*Primary Examiner* — Hwei-Siu C Payer

(74) *Attorney, Agent, or Firm* — Crowell & Moring LLP

(57) ABSTRACT

A knife may include a blade having first and second blade ends. A blade point may be disposed at the second blade end. A spine may be disposed between the first blade end and the second blade end. A cutting edge may oppose the spine. A primary bevel may be disposed between the spine and the cutting edge. A secondary bevel may be disposed between the primary bevel and the cutting edge. The secondary bevel may include a secondary bevel start line parallel to the spine and along a first longitudinal axis. A ricasso may be positioned at the first blade end adjacent to the cutting edge, the ricasso including a ricasso angle assist bevel. The ricasso angle assist bevel may include a ricasso angle assist bevel start line along a second longitudinal axis, wherein the second longitudinal axis is closer to the spine than the first longitudinal axis.

18 Claims, 13 Drawing Sheets

(56) References Cited

U.S. PATENT DOCUMENTS

| | | | | |
|---|---|---|---|---|
| 2008/0016704 | A1* | 1/2008 | Haneda | B26B 9/02 30/357 |
| 2009/0100683 | A1* | 4/2009 | Lion | B26B 3/00 30/138 |
| 2020/0180172 | A1* | 6/2020 | Godfrey | B26B 3/00 |
| 2020/0391397 | A1* | 12/2020 | Cauley, Jr | B26B 5/00 |

* cited by examiner

KNIFE WITH RICASSO ANGLE ASSIST BEVEL

CROSS REFERENCE TO RELATED APPLICATION

This application claims the benefit of the filing date under 35 U.S.C. § 119(e) of Provisional U.S. Patent Application Ser. No. 62/777,089, filed Dec. 8, 2018, wherein the entirety of the aforementioned application is hereby incorporated herein by reference.

BACKGROUND

1. Field

This disclosure relates generally to knives and more specifically to knives with one or more ricasso angle assist bevels.

2. Background Information

The knife is one of humanity's oldest known tools and as such, many individuals require a sharp knife—from a chef in a kitchen to a soldier on a battlefield. One of the greatest challenges facing people who depend on a sharp knife is re-sharpening their knife once it becomes dull. For traditional knives, a key to obtaining a sharp knife edge lies in the user's skill in the art of maintaining a consistent angle while running a knife edge along a sharpening stone. Those who are skilled in this technique can sharpen a knife with just a few swipes on a sharpening stone. Knife sharpening, however, generally requires a skill that is not quickly mastered. This skill takes most people years to perfect. In the meantime, it is very easy to do damage to a knife's edge through improper sharpening.

To avoid improper sharpening, non-experts use a jig. For a knife including a primary bevel and a secondary bevel, a jig establishes the angle of a knife's secondary bevel for forming a sharp cutting edge. A jig helps the knife sharpener maintain a consistent angle to sharpen a knife blade. These jigs are cumbersome and otherwise inconvenient to use. Jigs are carried as extra equipment or stored in a place off the user's person which renders sharpening in the field difficult to impossible.

Traditionally a knife ricasso is a portion of a knife between a guard (or if no guard is used then a handle) and a plunge line. A traditional ricasso is thus an unsharpened length of a blade positioned adjacent to a guard or handle. The lack of a traditional ricasso has little effect on how a knife is used. A traditional ricasso may save time in a traditional construction and make fixing a blade to a handle easier.

The ability to sharpen a knife blade without requiring an external jig or strong expertise is a challenge for those that depend on a sharp knife. There is a need for a device that provides more consistent and simplified knife sharpening. There is also a need for a solution to the burden of carrying and using a jig for sharpening.

SUMMARY

The descriptions below include at least knives and methods of sharpening the same. In one aspect, a knife includes a blade having a first blade end and a second blade end. A blade point is disposed at the second blade end. A spine is disposed between the first blade end and the second blade end. A cutting edge opposes the spine. A primary bevel is disposed between the spine and the cutting edge. A secondary bevel is disposed between the primary bevel and the cutting edge, the secondary bevel including a secondary bevel start line parallel to the spine and along a first longitudinal axis. A ricasso is positioned at the first blade end adjacent to the cutting edge, the ricasso including a ricasso angle assist bevel. The ricasso angle assist bevel may include a ricasso angle assist bevel start line along a second longitudinal axis, wherein the second longitudinal axis is closer to the spine than the first longitudinal axis.

In another aspect, a knife includes a blade having a first blade end and a second blade end. A blade point is disposed at the second blade end. A spine is disposed between the first blade end and the second blade end. A cutting edge opposes the spine. A primary bevel is disposed between the spine and the cutting edge. A secondary bevel is disposed between the primary bevel and the cutting edge. A ricasso is adjacent to the first blade end. The ricasso includes a ricasso angle assist bevel. The ricasso may further include a choil disposed adjacent to the cutting edge.

In yet another aspect, a knife includes a blade having a first blade end and a second blade end. The first blade end defines a ricasso and the second blade end defines a blade point. A cutting edge extends along one side of the blade from the ricasso to the blade point. A spine extends along a side of the blade opposite the cutting edge. The blade includes a primary bevel starting at a first distance from the spine, ending at a second distance from the spine greater than the first distance and extending parallel to the cutting edge from the ricasso to the second blade end. The blade further includes a secondary bevel formed starting at the second distance, ending at the cutting edge and extending parallel to the cutting edge from the ricasso to the second blade end. A ricasso angle assist bevel is formed in the ricasso and may be adjacent a start of the cutting edge. The ricasso angle assist bevel may start at a distance from the spine between the first distance and the second distance. The ricasso angle assist bevel is formed at a same angle as the secondary bevel.

BRIEF DESCRIPTION OF THE DRAWINGS

This disclosure may be better understood with reference to the following drawings and descriptions. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Figure 1A:
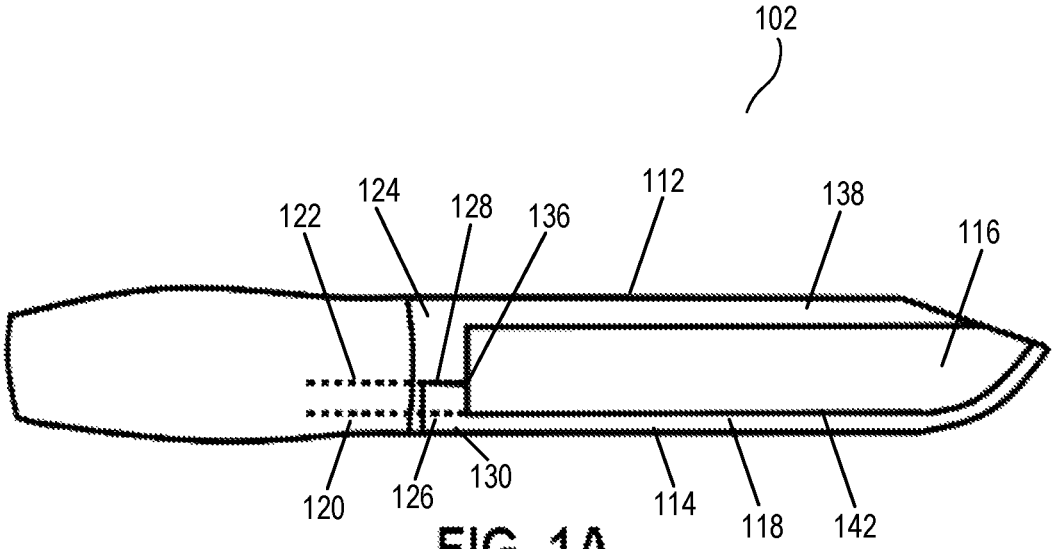
FIG. 1A shows a side view of a first example of a knife including a ricasso angle assist bevel.

The knife embodiments as disclosed provide solutions that reduce the time it takes for a user to develop an intuitive feel for a secondary bevel angle while sharpening, provide sharpening consistency, and eliminate the need for an external jig. The embodiments herein solve issues by providing easy-to-use built-in angle assist solutions that significantly decrease the time it takes for a user to develop a consistent and simple method of sharpening their knife using a portion of the knife itself as the jig. Using the described embodiments, a user may set and maintain the same angle across a blade.

Referring to FIGS. 1-2, in the present application the term ricasso 124 refers to a portion of a knife 102 between a first blade end 106 and a plunge line 136. An edge of the ricasso 124 closest to the first blade end 106 defines a plunge line 136. The plunge line 136 may be formed with a curved line or with a squared off, sharply angled line. A plunge line 136 may also be referred to as the grind termination (termination of the primary bevel 116 grind at a ricasso 124). The term choil 232 refers to an indentation that extends into at least one of a ricasso 224, a ricasso angle assist bevel 226, a primary bevel 216, a secondary bevel 218, or a combination thereof. Reference to coupling or connection of components, unless specified otherwise, includes direct connection as well as connection through intervening components.

Starting at or near a guard 234 or handle 140, without regard to the shape, size, or length of a blade 104, the disclosed embodiments allow a ricasso angle assist bevel 126 to establish the angle of the grind for a secondary bevel 118. The ricasso angle assist bevel 126 may be sharpened or unsharpened, but sharpening of the ricasso angle assist bevel 126 is not necessary for its function as a jig for setting the sharpening angle for a secondary bevel 118 to produce a cutting edge 114. The disclosure herein also provides a built-in jig that does not require an unreasonably large amount of skill and experience to master. The disclosure herein further provides a user with improved consistency in maintaining the secondary bevel 118 angle (edge geometry) while sharpening the cutting edge 114 of a knife 102. Certain embodiments include, but are not limited to, a knife 102 with a beveled, rather than completely flat, ricasso 124 that may be used as a jig to remain consistent with the angle of the secondary bevel 118 during sharpening of a cutting edge 114. Embodiments disclosed herein eliminate the need for an external knife bevel grinding jig to maintain consistent edge geometry during sharpening.

Figure 1B:
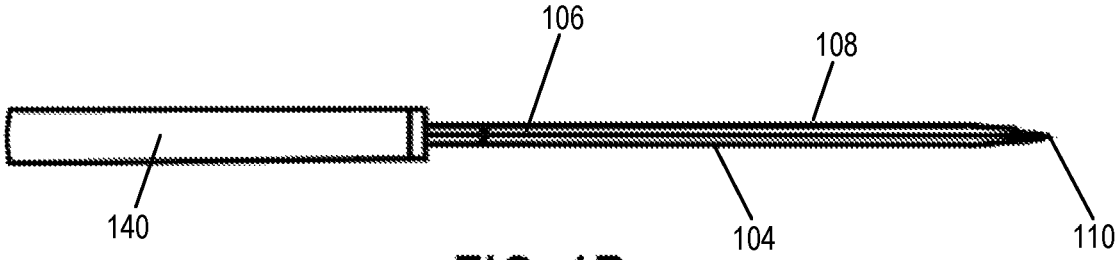
FIG. 1B shows a bottom view of the knife of FIG. 1A.

FIGS. 1A-B depict an example of a knife 102. The knife 102 includes a blade 104 extending between a first blade end 106 and a second blade end 108. A knife 102 may include a fixed blade 104. A knife 102 may alternatively include a folded blade 104. If a knife 102 includes a folded blade 104, the blade 104 folds into a handle 140 at a pivot point. A blade 104 may include a steel such as carbon steel, stainless steel, tool steel, alloy steel, Damascus steel, or a cobalt alloy, a titanium alloy, a ceramic, obsidian, a plastic, or a combination thereof.

A blade point 110 is disposed at the second blade end 108. The blade point 110 may define an angle where the spine 112 and the cutting edge 114 connect. Connection between the spine 112 and the cutting edge 114 at the blade point 110 may be a direct connection or a connection including one or more intervening components. An intervening component may be, for example, a sharpened portion of the blade 104. In this example, a sharpened portion of the blade 104 may extend from the spine 112 to the blade point 110. The blade point 110 may be sharp.

A spine 112 is disposed between the first blade end 106 and the second blade end 108. A cutting edge 114 opposes the spine 112. The spine 112 extends along a side of the blade 104 opposite the cutting edge 114. The spine 112 may be the thickest portion of the length of a blade 104 from a ricasso 124 to the blade point 110. The cutting edge 114 extends along one side of the blade 104 from the ricasso 124 to the blade point 110. The cutting edge 114 may curve at the second blade end 108 adjacent the blade point 110.

A primary bevel 116 is disposed between the spine 112 and the cutting edge 114. The blade 104 includes a primary bevel 116 starting at a first distance from the spine 112, ending at a second distance from the spine 112 greater than the first distance and extending parallel to the cutting edge 114 from the ricasso 124 to the second blade end 108. A flat region 138 may be disposed between the spine 112 and the first distance. The primary bevel 116 may be flat or concavely ground. In some embodiments, the primary bevel 116 is the same angle as the flat region 138. In other embodiments, the primary bevel 116 includes a concave and/or rounded transition point at the first distance from the spine 112. In some embodiments, the primary bevel 116 extends in the shape of a circular arc.

A secondary bevel 118 is disposed between the primary bevel 116 and the cutting edge 114. The blade 104 further includes a secondary bevel 118 formed starting at the second distance, ending at the cutting edge 114 and extending parallel to the cutting edge 114 from the ricasso 124 to the second blade end 108. A secondary bevel 118 may be flat or concavely ground. The secondary bevel 118 includes a secondary bevel start line 142 parallel to the cutting edge and along a first longitudinal axis 120. The ricasso angle assist bevel 126 includes a ricasso angle assist bevel start line 128 along a second longitudinal axis 122. The second longitudinal axis 122 is closer to the spine 112 than the first longitudinal axis 120.

A ricasso 124 is positioned at the first blade end 106 adjacent to the cutting edge 114. The ricasso 124 includes a ricasso angle assist bevel 126. A ricasso angle assist bevel 126 is formed in the ricasso 124 and may be adjacent a start of the cutting edge 114. A ricasso angle assist bevel 126 may be flat or concavely ground. A ricasso angle assist bevel 126 may be used as a jig to establish the desired angle for sharpening a blade's 104 secondary bevel 118. The size, sharpness, and shape of the ricasso 124 will not impede its function as the angle assist jig.

Figure 2A:
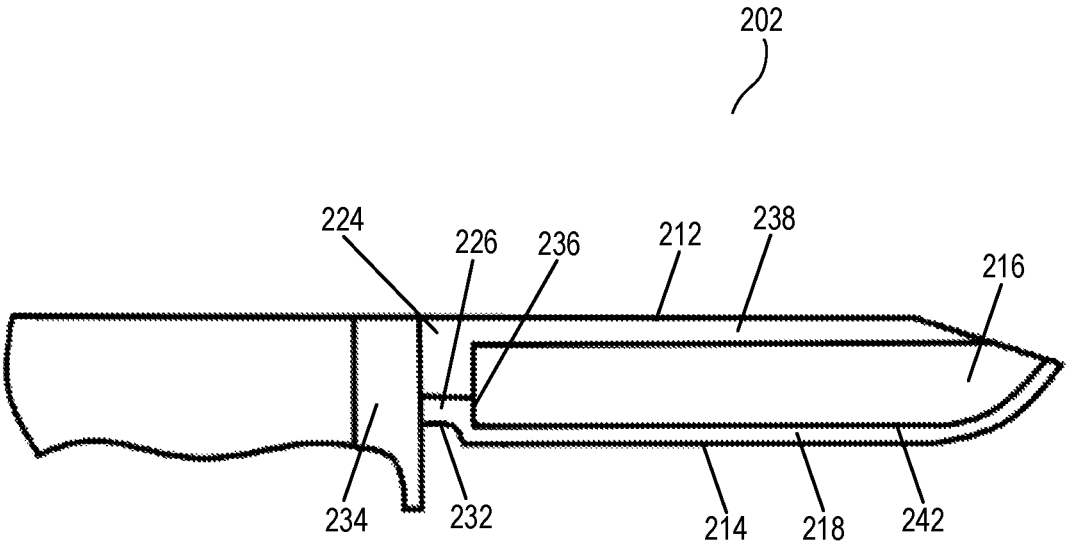
FIG. 2A shows a side view of a second example of a knife including a ricasso angle assist bevel.
Figure 2B:
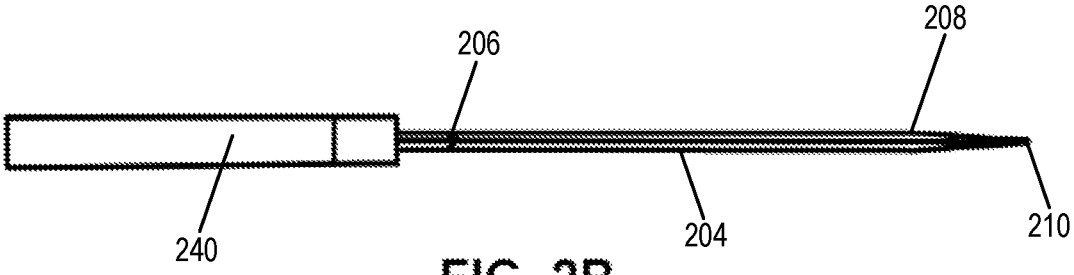
FIG. 2B shows a bottom view of the knife of FIG. 2A.
Figure 3A:
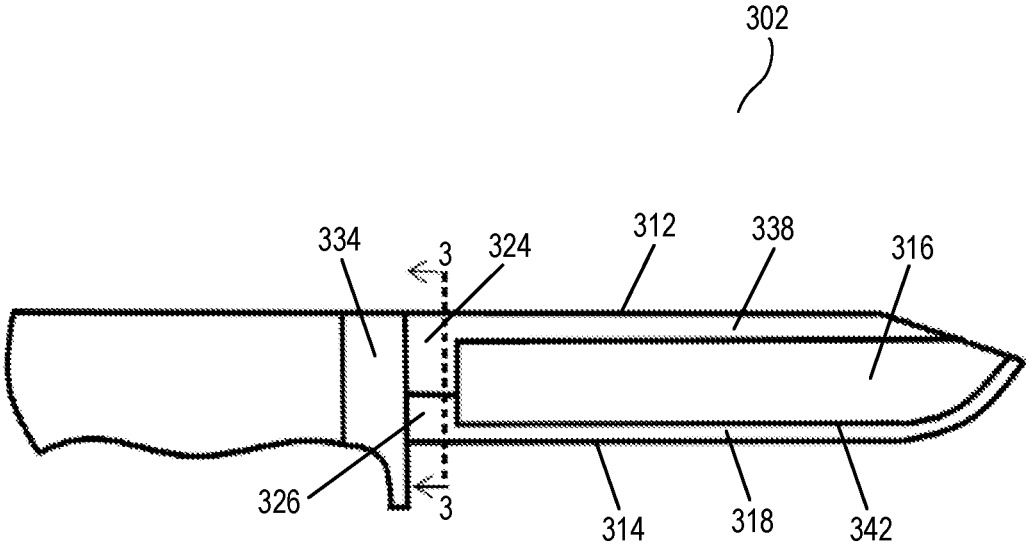
FIG. 3A shows a side view of a third example of a knife including a ricasso angle assist bevel.
Figure 3B:
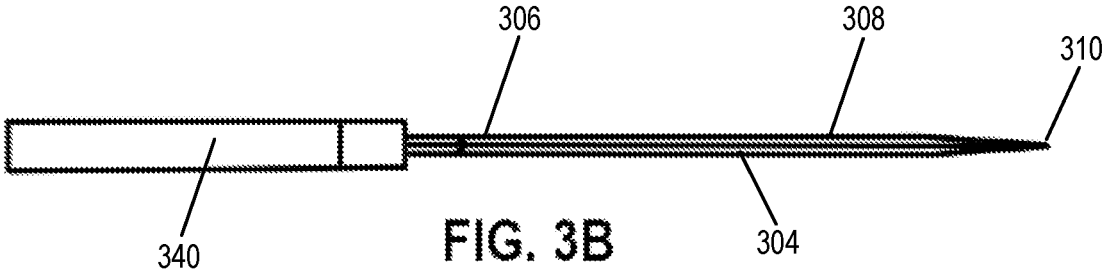
FIG. 3B shows a bottom view of the knife of FIG. 3A.
Figure 4A:
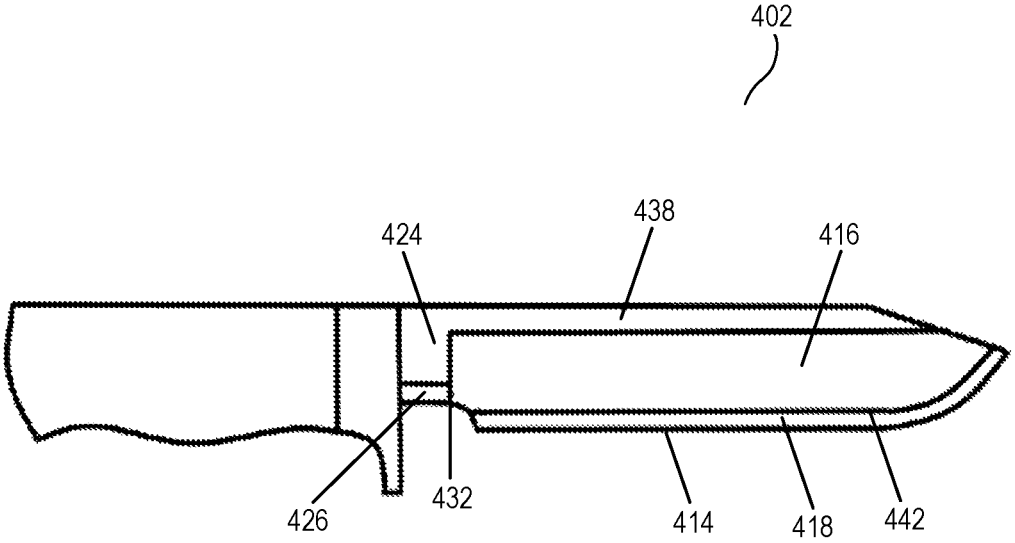
FIG. 4A shows a side view of a fourth example of a knife including a ricasso angle assist bevel.
Figure 4B:
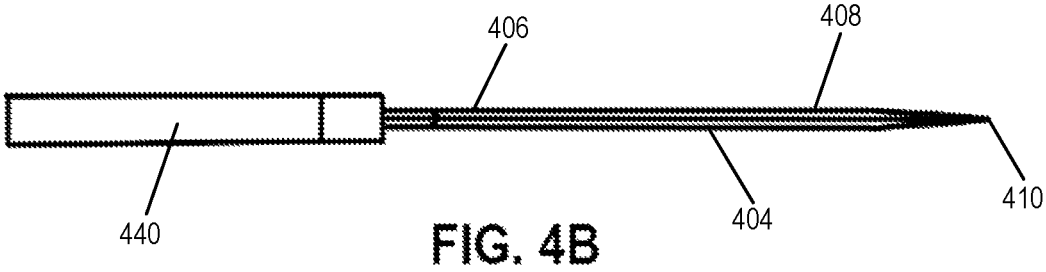
FIG. 4B shows a bottom view of the knife of FIG. 4A.

In some examples, the ricasso angle assist bevel end line 130 may run consistently across the blade 104, as shown in FIGS. 1A-B, 3A-B, and 5A-B. In alternative embodiments, for example as shown in FIG. 2A, a knife includes a choil 232. The ricasso angle assist bevel 226 may include a choil 232 disposed adjacent to the cutting edge 214. A choil 232 may extend into at least one of a ricasso 224, a ricasso angle assist bevel 226, a primary bevel 216, a secondary bevel 218, or a combination thereof. A choil 232 may connect to the cutting edge 214. FIGS. 2A-B depict a second example of a knife 202 where the ricasso 224 includes a choil 232 disposed adjacent to the cutting edge 214. FIGS. 4A-B depict a fourth example of a knife 402 including a choil 432 that extends into the ricasso 424, the ricasso angle assist bevel 426, and the primary bevel 416.

A guard 334 may be adjacent to the ricasso 324. FIGS. 3A-B depict a third example of a knife 302 including a guard 334. A guard 334 may help protect a knife 302 user from accidental self-injury while using the knife 302. A guard 334 may prevent a user's hand from easily moving from the handle 340 towards the blade 304 and cutting edge 314. A handle 340 may be adjacent to the ricasso 324 and/or a guard 334. A handle 340 may be made of wood, a metal such as steel, plastic, bone, or a combination thereof.

Figure 5A:
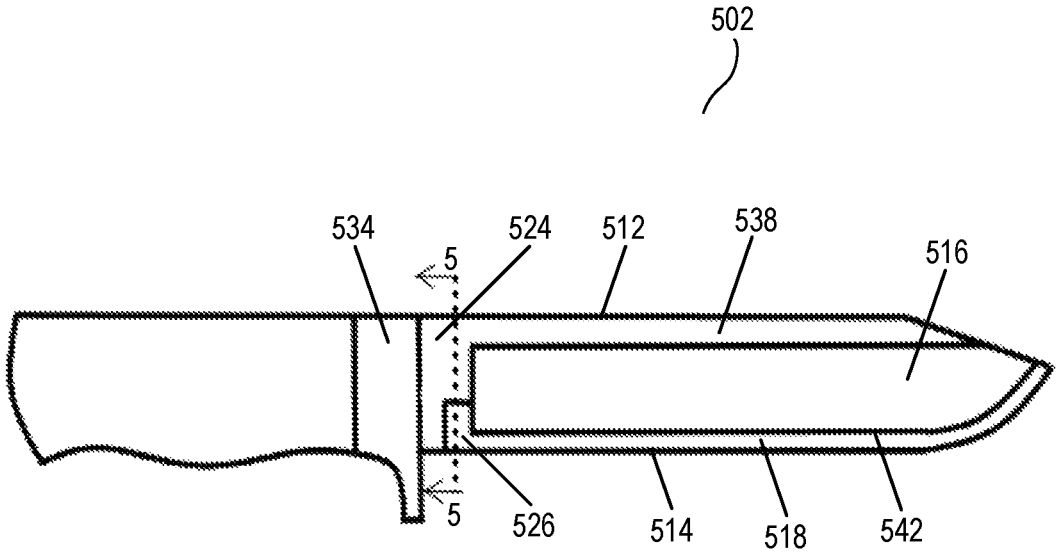
FIG. 5A shows a side view of a fifth example of a knife including a ricasso angle assist bevel.
Figure 16:
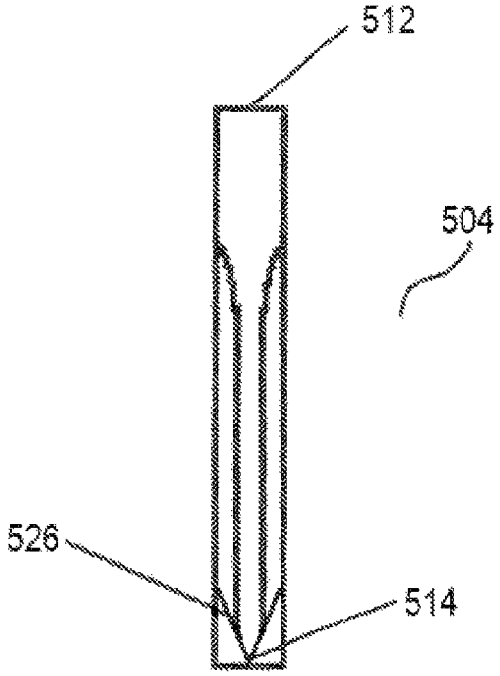
FIG. 16 shows a cross-sectional view of the fifth example of a knife in FIGS. 5A-B including a ricasso angle assist bevel.

In some embodiments, a ricasso angle assist bevel 226 spans a ricasso 224, for example, as shown in FIGS. 2-4. In FIGS. 2-4, the ricasso angle assist bevels 226 extend from a guard 234 to the plunge line 236. In alternative embodiments, a ricasso angle assist bevel 126 may span only a portion of the ricasso 124, for example, as shown in FIGS. 1A and 5A. In FIG. 1A, the ricasso 124 includes a ricasso angle assist bevel 126 at a distance from a handle 140. The portion of the ricasso 124 in FIG. 1A between the ricasso angle assist bevel 126 and the handle 140, therefore, is formed as a traditional ricasso. In FIG. 5A, the ricasso 524 includes a ricasso angle assist bevel 526 at a distance from a guard 534. The portion of the ricasso 524 in FIG. 5A between the ricasso angle assist bevel 526 and the guard 534, therefore, is formed as a traditional ricasso. FIG. 16 shows a cross sectional view of the knife 502 shown in FIGS. 5A-B.

A ricasso angle assist bevel 126 may start at a distance from the spine 112 between the first distance and the second distance. The ricasso angle assist bevel 126 is formed at a same angle as the secondary bevel 118. The same angle thus extends across a ricasso angle assist bevel 126 past the plunge line 136 to the secondary bevel 118. The ricasso angle assist bevel 126 further includes an end line 130. In some embodiments, the ricasso angle assist bevel end line 130 is tapered or sharp. In other embodiments, the ricasso angle assist bevel end line 130 is blunt, dull, rounded, flat, or unsharpened.

The ricasso angle assist bevel 326 is formed at a same angle as the secondary bevel 318. This angle is the angle between the ricasso angle assist bevel 326 and a center line 346 of a blade 304. The angle is also the angle between the secondary bevel 318 and the center line 346 of the blade 304 (e.g. FIG. 6). The ricasso angle assist bevel 326 may define an angle of about 7 degrees to about 15 degrees; about 15 degrees to about 30 degrees; about 5 degrees to about 50 degrees; about 5 degrees to about 10 degrees; about 10 degrees to about 20 degrees; about 20 degrees to about 30 degrees; about 30 degrees to about 40 degrees; about 40 degrees to about 50 degrees; or about 7 degrees to about 35 degrees.

A width of the ricasso angle assist bevel 126 extending from the first blade end 106 toward the second blade end 108 may be shorter than a length of the secondary bevel 118 extending from the first blade end 106 toward the second blade end 108. The ricasso angle assist bevel 126 has a length extending from a ricasso angle assist bevel start line 128 to a ricasso angle assist bevel end line 130, and the secondary bevel 118 determines the length of the ricasso angle assist bevel 126. The length of the ricasso angle assist bevel 126 extending from the first blade end 106 toward the second blade end 108 is about one-eighth of an inch to about 1 inch; about one half of an inch to about 1 inch; or about three fourths of an inch to about 1 inch. In some embodiments, the length of the ricasso 124 is about or does not exceed (i.e. less than or equal to) a fourth of the length of the blade 104.

Figure 5B:
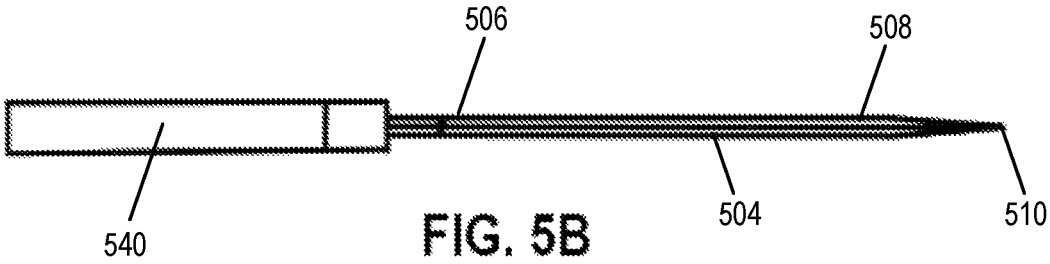
FIG. 5B shows a bottom view of the knife of FIG. 5A.

FIGS. 5A-B depict a fifth example of a knife 502. The ricasso 524 has a width extending from the ricasso 524 end closest to the first blade end 506 towards the second blade end 508, and the ricasso angle assist bevel 526 extends for a portion of the ricasso 524 width.

Figure 6:
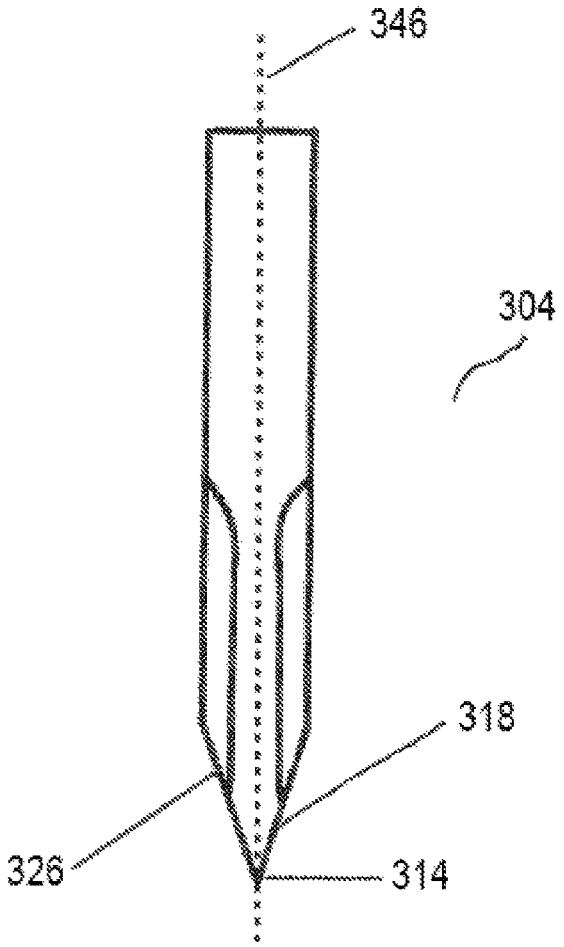
FIG. 6 shows a cross-sectional view of the third example of a knife in FIGS. 3A-B including a ricasso angle assist bevel.

FIG. 6 depicts a cross sectional view of a blade 304 along line 3-3 as shown in FIG. 3A. A third example of a knife 302 with a blade 304 that is double sided (e.g. the combination of FIGS. 3A-B and FIGS. 14A-B) includes two ricasso angle assist bevels 326*a*, 326*b* (see also FIGS. 11-12). In a double-sided embodiment, on one side each of the primary bevel 316, the secondary bevel 318, and the ricasso angle assist bevel 326 may be flat or concavely ground and the other side of each of the primary bevel 316, the secondary bevel 318, and the ricasso angle assist bevel 326 may be flat or concavely ground.

Figure 7:
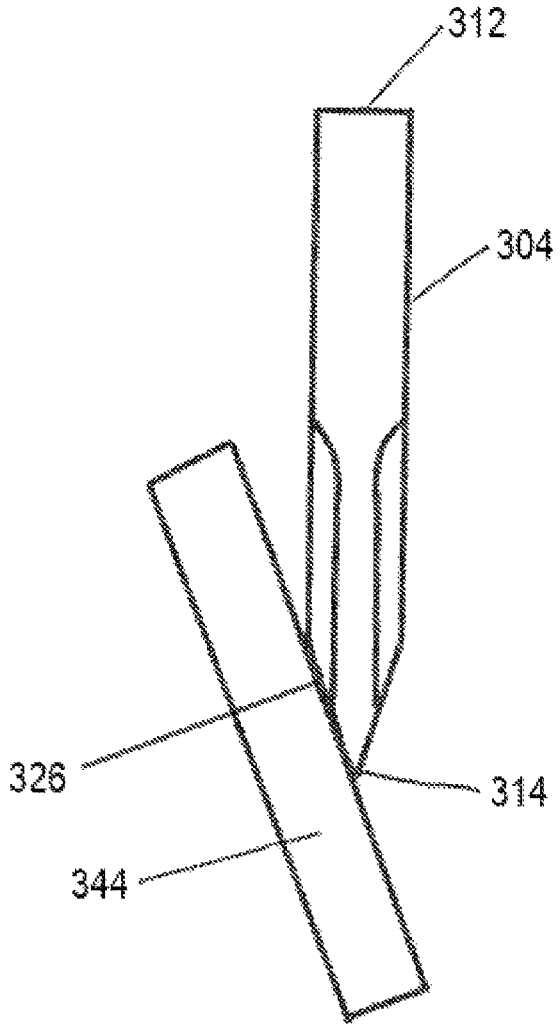
FIG. 7 shows a cross-sectional view of the third example of a knife in FIGS. 3A-B including a ricasso angle assist bevel with a sharpening stone.

FIG. 7 depicts the knife 302 of FIG. 3A (e.g. the combination of FIGS. 3A-B and FIGS. 14A-B) with a sharpening stone 344. As shown in FIG. 7, the ricasso angle assist bevel 326 functions as an improved, integrated knife 302 sharpening jig. A ricasso angle assist bevel 326 establishes the grind angle making it easier for a user to hold the knife 302 and a sharpening stone 344 at the desired angle across a secondary bevel 318. In one embodiment of a method of sharpening a knife 302, a user places a sharpening stone 344 against a ricasso angle assist bevel 326 to achieve the desired angle for sharpening. The user maintains the angle achieved with the ricasso angle assist bevel 326 while moving the blade 304 in a direction from the ricasso 324 toward the blade point 310 across at least a portion of the sharpening stone 344.

Figure 8:
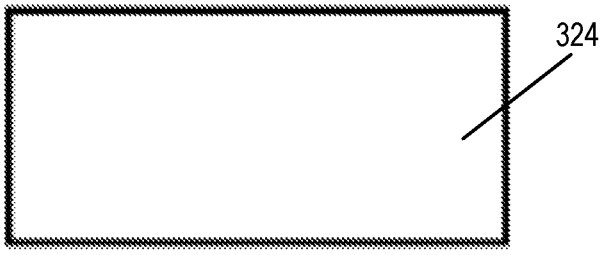
FIG. 8 shows a cross-sectional view of an example of at least a portion of a ricasso.
Figure 9:
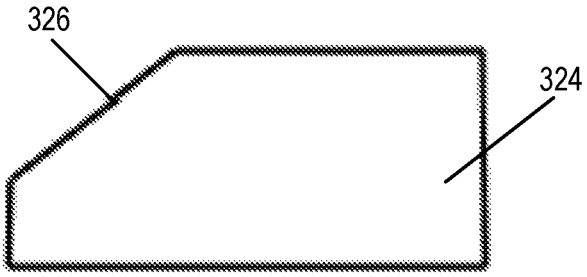
FIG. 9 shows a cross-sectional view of a second example of at least a portion of a ricasso.
Figure 10:
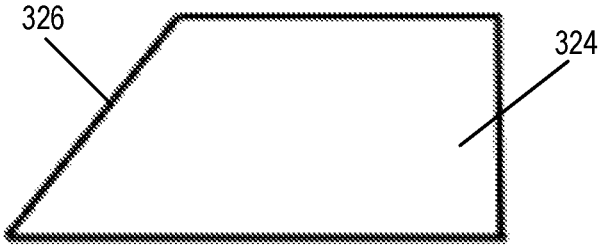
FIG. 10 shows a cross-sectional view of a third example of at least a portion of a ricasso.
Figure 11:
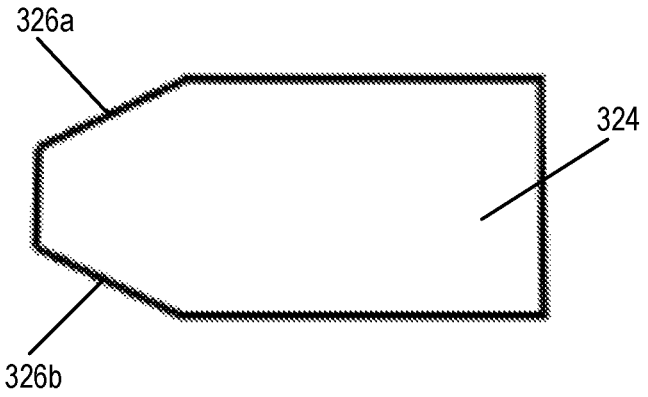
FIG. 11 shows a cross-sectional view of a fourth example of at least a portion of a ricasso.
Figure 12:
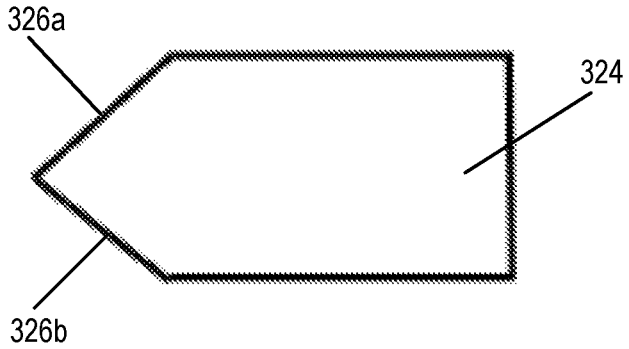
FIG. 12 shows a cross-sectional view of a fifth example of at least a portion of a ricasso.

FIGS. 8-12 depict exemplary cross sections of ricasso embodiments. FIG. 8 depicts a cross section of a portion of a ricasso 324 disposed between a ricasso angle assist bevel 326 and a guard 334 or a handle 340. FIG. 9 depicts a cross section of an unsharpened ricasso angle assist bevel 326. FIG. 10 depicts a cross section of a sharpened ricasso angle assist bevel 326. FIG. 11 depicts a cross section of double-sided knife 302 with an unsharpened ricasso 324 including ricasso angle assist bevels 326*a*, 326*b*. FIG. 12 depicts a cross section of double-sided knife 302 with a sharpened ricasso 324 including ricasso angle assist bevels 326*a*, 326*b*.

Figure 13A:
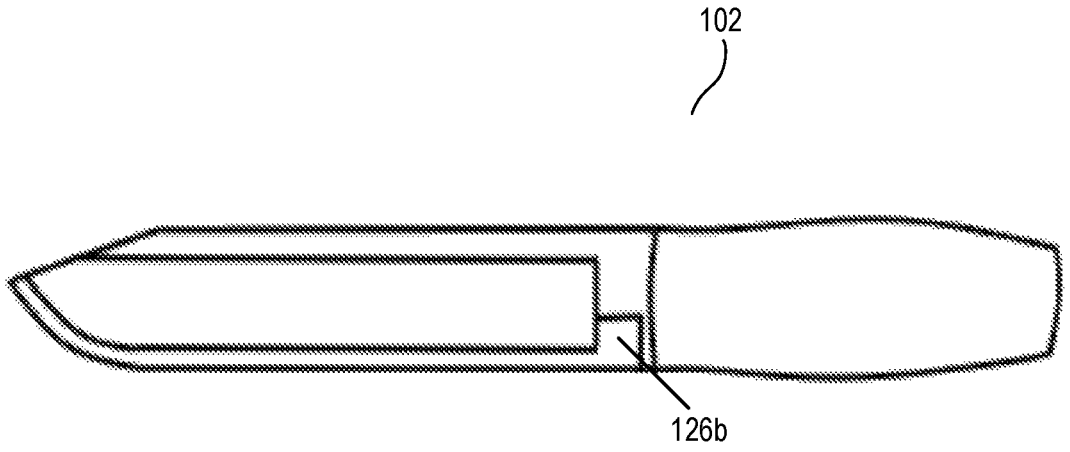
FIG. 13A shows a flipped side view of the first example of a knife including a ricasso angle assist bevel in FIG. 1A.
Figure 13B:
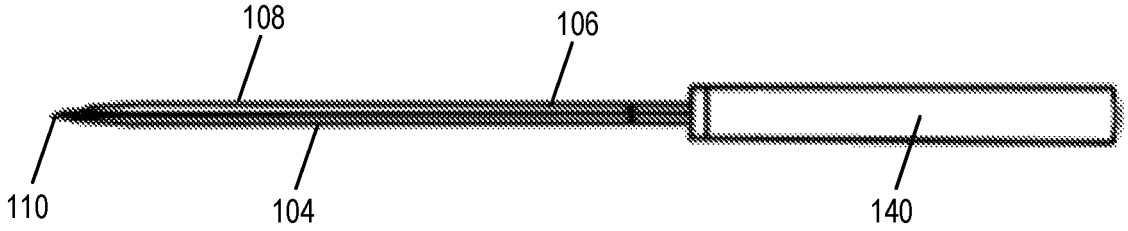
FIG. 13B shows a bottom view of the knife of FIG. 13A.
Figure 14A:
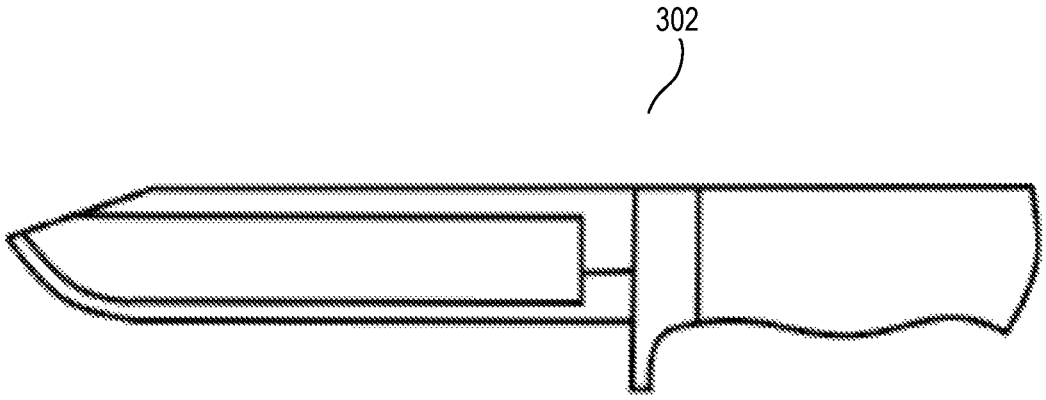
FIG. 14A shows a flipped side view of the third example of a knife including a ricasso angle assist bevel in FIG. 3A.
Figure 14B:
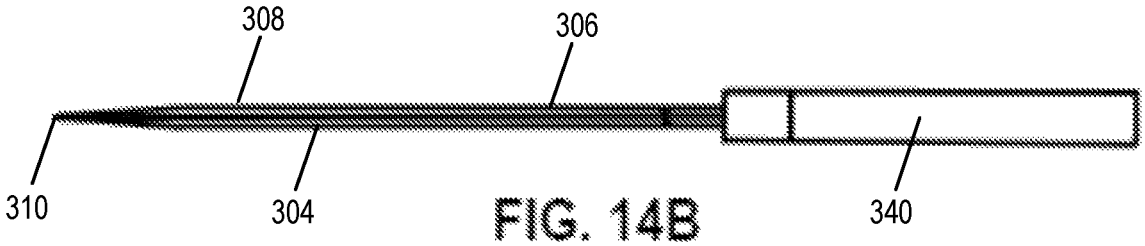
FIG. 14B shows a bottom view of the knife of FIG. 14A.
Figure 15A:
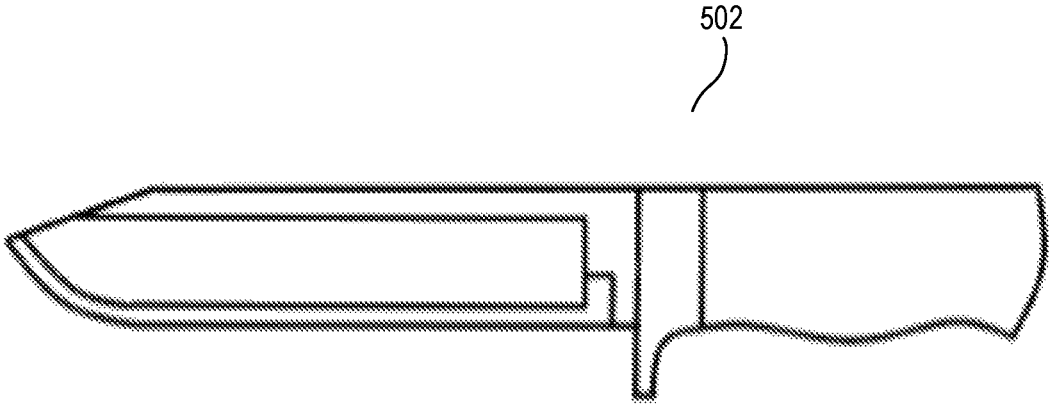
FIG. 15A shows a flipped side view of the fifth example of a knife including a ricasso angle assist bevel in FIG. 5A.
Figure 15B:
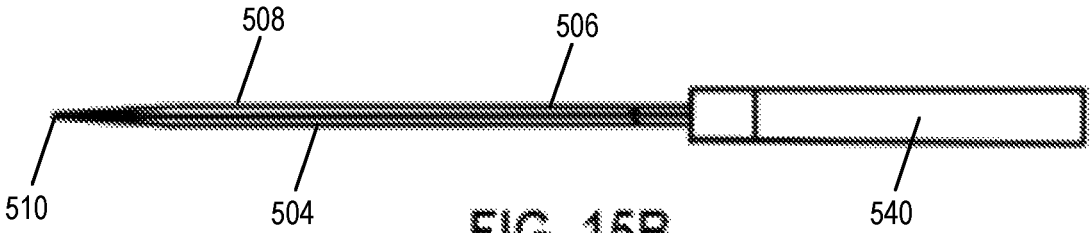
FIG. 15B shows a bottom view of the knife of FIG. 15A.

FIGS. 13A-B depict the knife 102 of FIGS. 1 A flipped 180 degrees so that the opposing side of the knife 102 of FIG. 1A is shown. In this embodiment, FIG. 1A's ricasso angle assist bevel 126 would be a first ricasso angle assist bevel 126*a*. As shown in the embodiment of FIG. 13A, an additional and second ricasso angle assist bevel 126*b* opposes the first ricasso angle assist bevel 126*a*. FIG. 16 depicts a cross sectional view of the fifth example of a knife 502 blade 504 along line 5-5 as shown in FIG. 5A.

Individuals could benefit from using the disclosed embodiments because the disclosed embodiments are easier and quicker to use than other sharpening devices and methods. The disclosed embodiments are compatible with small and thin knives, such as those used in culinary applications, as well as larger knives preferred by hunters, soldiers, and outdoorsmen and women. The disclosed embodiments may be used in collaboration with blades of a wide variety of sizes, lengths, and thicknesses.

The disclosed embodiments may be appropriate and suitable for a wide range of knives such as, for example, a bread knife, a boning knife, a butcher knife, a chef knife, a cleaver, a paring knife, a hunting knife, a slicing knife, a utility knife, a folding knife, a breaking knife, a cheese knife, a table knife, a steak knife, a cimeter knife, a flank knife, a shoulder knife, a scalpel, a survival knife, an outdoorsperson knife, a gyuto knife, a meat carving knife, a nakiri knife, an oyster knife, a fishing knife, a military knife, a petty knife, a santoku knife, a sashimi knife, a hunting knife, a forged knife, or a stamped knife.

The use of the various exemplary reference numerals herein is not limiting. For example, a portion of one embodiment may be combined with, integrated into, or substituted for an element of another disclosed embodiment. The first digit of the reference numerals disclosed herein may be changed from and to any of 1, 2, 3, 4, or 5 to refer to the same various elements (e.g. 124, 224, 324, 424, and 524 all refer to a ricasso in various embodiments). While various embodiments are described herein, the disclosure is not to be restricted except in light of the attached claims and equivalents. Moreover, the advantages described herein are not necessarily the only advantages and it is not necessarily expected that every embodiment will achieve all of the advantages described.

What is claimed is:

1. A knife, comprising:

a blade having a first blade end and a second blade end; a blade point disposed at the second blade end;

a spine disposed between the first blade end and the second blade end;

a cutting edge opposing the spine;

a primary bevel disposed between the spine and the cutting edge;

a secondary bevel disposed between the primary bevel and the cutting edge, the secondary bevel comprising a secondary bevel start line parallel to the cutting edge and along a first longitudinal axis; and a ricasso positioned at the first blade end adjacent to the cutting edge, the ricasso comprising:

a ricasso angle assist bevel, and the ricasso angle assist bevel comprising a ricasso angle assist bevel start line along a second longitudinal axis, wherein the second longitudinal axis is closer to the spine than the first longitudinal axis.

2. The knife of claim 1, wherein the ricasso angle assist bevel further comprises an end line and the ricasso angle assist bevel end line is unsharpened.

3. The knife of claim 1, wherein the ricasso angle assist bevel further comprises an end line and the ricasso angle assist bevel end line is sharp.

4. The knife of claim 1, wherein the ricasso angle assist bevel further comprises a choil disposed adjacent to the cutting edge.

5. The knife of claim 1, wherein the ricasso angle assist bevel is formed at a same angle as the secondary bevel.

6. The knife of claim 1, further comprising a guard adjacent to the ricasso.

7. A knife, comprising:

a blade having a first blade end and a second blade end; a blade point disposed at the second blade end;

a spine disposed between the first blade end and the second blade end;

a cutting edge opposing the spine;

a primary bevel disposed between the spine and the cutting edge; a secondary bevel disposed between the primary bevel and the cutting edge; and a ricasso adjacent to the first blade end, wherein the ricasso comprises a ricasso angle assist bevel spaced from the spine, and wherein the ricasso angle assist bevel is formed at a same angle as the secondary bevel.

8. The knife of claim 7, wherein an edge of the ricasso closest to the first blade end defines a plunge line.

9. A knife, comprising:

a blade having a first blade end and a second blade end, the first blade end defining a ricasso and the second blade end defining a blade point;

a cutting edge extending along one side of the blade from the ricasso to the blade point; and a spine extending along a side of the blade opposite the cutting edge;

wherein the blade further comprises:

a primary bevel starting at a first distance from the spine, ending at a second distance from the spine greater than the first distance and extending parallel to the cutting edge from the ricasso to the second blade end;

a secondary bevel formed starting at the second distance, ending at the cutting edge and extending parallel to the cutting edge from the ricasso to the second blade end; and a ricasso angle assist bevel formed in the ricasso and adjacent a start of the cutting edge, the ricasso angle assist bevel starting at a distance from the spine between the first distance and the second distance, wherein the ricasso angle assist bevel is formed at a same angle as the secondary bevel.

10. The knife of claim 9, wherein the ricasso has a width extending from an end of the ricasso closest to the first blade end towards the second blade end, and the ricasso angle assist bevel extends for a portion of the ricasso width.

11. The knife of claim 9, wherein the ricasso angle assist bevel has a length extending from a ricasso angle assist bevel start line to a ricasso angle assist bevel end line.

12. The knife of claim 9, wherein a length of the ricasso angle assist bevel extending from the first blade end toward the second blade end is shorter than a length of the secondary bevel extending from the first blade end toward the second blade end.

13. The knife of claim 9, wherein a length of the ricasso angle assist bevel extending from the first blade end toward the second blade end is less than a length of the primary bevel and a length of the secondary bevel.

14. The knife of claim 9, further comprising a handle adjacent to the ricasso.

15. The knife of claim 9, wherein the cutting edge curves at the second blade end adjacent the blade point.

16. The knife of claim 9, further comprising a flat region between the spine and the first distance.

17. The knife of claim 9, wherein the ricasso angle assist bevel defines an angle, between the ricasso angle assist bevel and a center line of the blade, in the range of between 5 degrees and 50 degrees.

18. The knife of claim 9, further comprising an additional ricasso angle assist bevel opposing the ricasso angle assist bevel.

* * * * *